US006312267B1

(12) United States Patent
Wang

(10) Patent No.: US 6,312,267 B1
(45) Date of Patent: Nov. 6, 2001

(54) AUDIO CONNECTOR GROUNDING PIECE

(76) Inventor: Yao Te Wang, 5F, No. 501-12, Chung Cheng Rd., Hsin Tien City, Taipei Hsien (TW)

( * ) Notice: Subject to any disclaimer, the term of this patent is extended or adjusted under 35 U.S.C. 154(b) by 0 days.

(21) Appl. No.: 09/716,233

(22) Filed: Nov. 21, 2000

(51) Int. Cl.[7] ..... H01R 13/648; H01R 4/66; H01R 24/04

(52) U.S. Cl. ..... 439/92; 439/669; 439/939

(58) Field of Search ..... 439/668, 669, 439/92, 939

(56) References Cited

U.S. PATENT DOCUMENTS

| | | | | |
|---|---|---|---|---|
| 5,622,523 | * | 4/1997 | Kan et al. | 439/607 |
| 5,913,698 | * | 6/1999 | Keng | 439/609 |
| 6,093,058 | * | 7/2000 | Wu | 439/607 |
| 6,168,448 | * | 1/2001 | Chang | 439/188 |
| 6,190,205 | * | 2/2001 | Wu | 439/607 |
| 6,213,812 | * | 4/2001 | Kan | 439/607 |
| 6,220,898 | * | 4/2001 | Wu | 439/668 |
| 6,220,899 | * | 4/2001 | Suzuki | 439/675 |

* cited by examiner

*Primary Examiner*—Paula Bradley
*Assistant Examiner*—Edwin A. León
(74) *Attorney, Agent, or Firm*—Rosenberg, Klein & Lee

(57) ABSTRACT

An audio connector grounding piece is disclosed. A primary seat has an inserting hole facing outwards and installed at a front end surface of the primary seat. An edge of the inserting hole is formed with an annular groove; and the inner surface of the annular groove is installed with a cambered strip. A top surface and a bottom surface of the primary seat being installed with a pair of buckles and two inward folded edges, respectively, which are formed as a ⊂ shape. Buckles are embedded into the respective grooves at two end of a frame. A lower end plate of the frame is connected to a ground leg; and the lateral plate of the frame has a through hole. A ground piece folded into two halves is buckled to the inner folded edge of the primary seat by the outer folding at a top of the longitudinal plate. The ground piece has a longitudinal plate and a tilt plate each of which has respective holes. A bush has an outer surface which has three stages and are reduced towards the primary seat gradually. An insulating cover has an outer end which has an annular trench for being connected with and then positioning the outer section of the bush. The insulating cover passes through the ground piece and frame to be fixed to the annular groove of the primary seat.

6 Claims, 5 Drawing Sheets

AUDIO CONNECTOR GROUNDING PIECE

FIELD OF THE INVENTION

The present invention relates to an audio connector grounding piece, and especially to an improved integral ground piece for a three stage plug connector.

BACKGROUND OF THE INVENTION

Audio connectors are installed in computers for being connected with a stereo. FIG. 1 shows a prior art structure which has an insulting seat 1. A rear end surface of the insulating seat 1 is connected to a rear cover 17. The insulating seat 1 is fixed to four terminals via a plurality of positioning grooves. Since these terminals serve to transfer signals and has no relation to the ground piece, their details will not be further described herein.

A protruded round cylinder 14 is formed at one front surface of the insulating seat 1. Then, the round cylinder 14 is engaged with a respective terminal so that the plug of a stereo may insert into the round cylinder 14 so as to be in contact with the terminals.

A ground piece 10 is installed for abating the interfering effects of noise. One end of the ground piece 10 is bent as an inserting end 11 for being inserted into an embedded groove 13 of the insulating seat 1. The embedded groove 13 is positioned at the bottom of the insulating seat 1 near the front end. The engagement of the inserting end 11 with the embedded groove 13 prevents the ground piece 10 from sliding.

The inserting end 11 and the body of the ground piece 10 are formed as a tilt hook. The body includes a frame type ground portion 12 which extends about the periphery of the round cylinder 14. The inserting end 11 has an L shape for being positioned in the embedded groove 13.

A further grounding terminal 15 is installed. The grounding terminal has an approximate T shape. The transverse section thereof is engaged to a retaining groove 16 at the bottom of the insulating seat 1. Meanwhile, the front end of the transverse section extends forward so as to be connected to the ground piece 10. A longitudinal section of the grounding terminal 15 is a pin portion. This pin portion and the pins of the terminals can be inserted into a mother board so that the whole connector is fixed to the mother board, and the ground piece 10 is placed in contact with the casing.

Through the grounding terminal, electromagnetic waves are guided into a wave removing circuit on the mother board so that the interference is reduced to a minimum. Consequently, the quality of signal transmission is preserved. However, the prior art ground piece 10 cannot be securely fixed and tends to easily fall off so as to deteriorate the transmission of signals. There is a need to remedy this problem.

SUMMARY OF THE INVENTION

Accordingly, the primary object of the present invention is to provide an audio connector grounding piece which improves upon the prior art. The inner ground piece is redesigned for matching with a separable insulating cover on the primary seat. The length of the primary seat is reduced so that the primary seat can be controlled more precisely and yield ratio may be improved. The ground piece can be easily assembled to the primary seat. The ground piece is thus firmly affixed such that the stability of signal transmission with the ground piece is improved. The point contact between the prior art ground piece and the prior art ground leg is replaced by a surface contact so that the conduction speed is quicker.

To achieve these objects, the present invention provides an audio connector grounding piece. A primary seat has an inserting hole facing outwards, and the grounding piece is installed at a front end surface of the primary seat. An edge of the inserting hole is formed with an annular groove; and, the inner surface of the annular groove is formed with a cambered strip. A top surface and a bottom surface of the primary seat are installed with a pair of buckles and with two inward folded edges defining a substantial U-shape. Buckles are embedded into the respective grooves at two ends of a frame. A lower end plate of the frame is connected to a ground leg; and, the lateral plate of the frame has formed therein a through hole. A ground piece folded to define two halves is buckled to the inner folded edge of the primary seat by the outer folding at a top of the longitudinal plate. The ground piece has a longitudinal plate and a tilt plate each of which has a respective hole. The outer surface of a bushing has three stages which are incrementally reduced in diametric dimension towards the primary seat. An insulating cover has an outer end which has an annular tench for being connected with and positioning the outer section of the bushing. The insulating cover passes through the ground piece and frame to be fixed to the annular groove of the primary seat.

The various objects and advantages of the present invention will be more readily understood from the following detailed description when read in conjunction with the appended drawings.

DETAILED DESCRIPTION OF THE PREFERRED EMBODIMENTS

Figure 1:
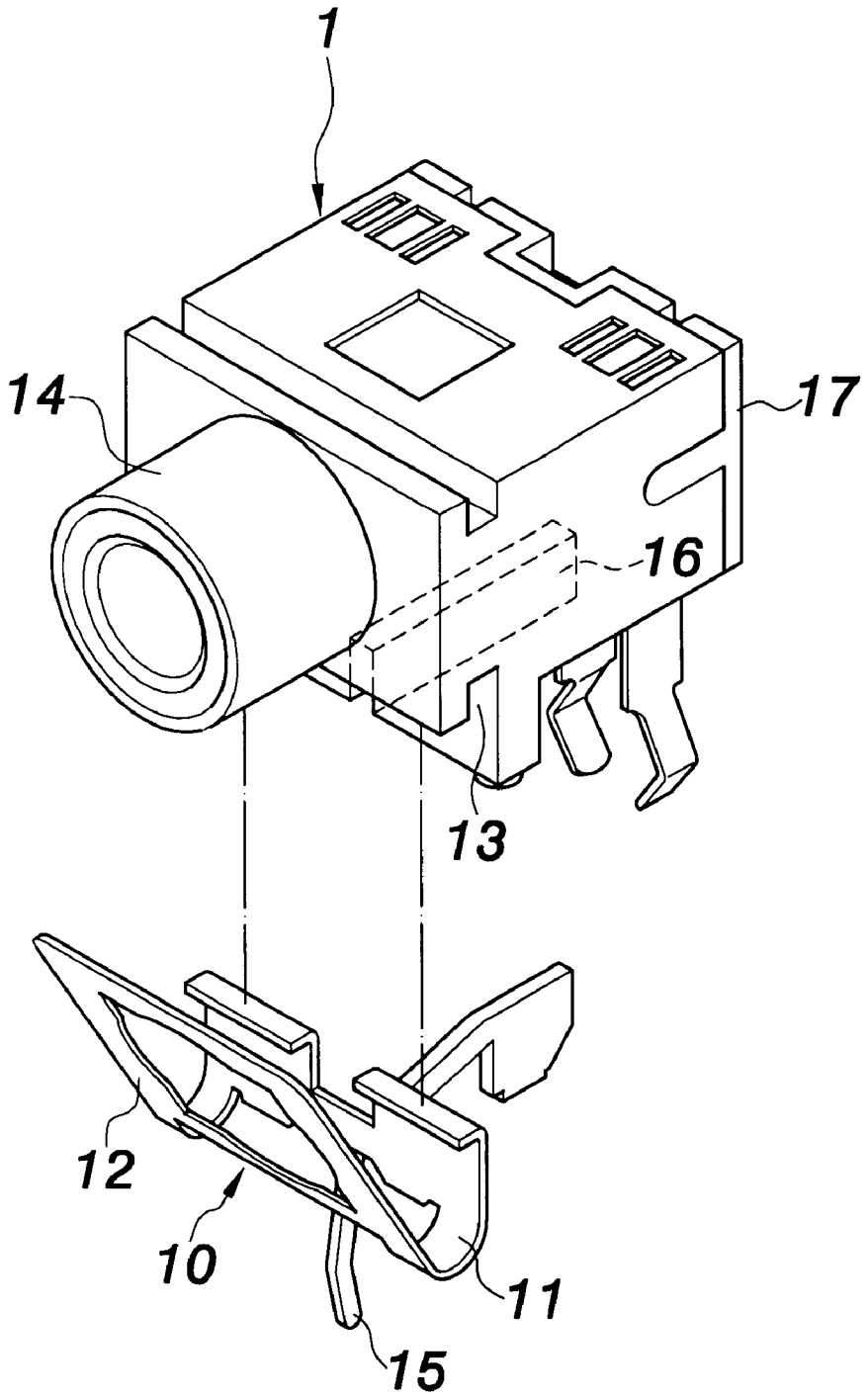
FIG. 1 PRIOR ART
FIG. 1 is an exploded perspective view of the prior art.
Figure 2:
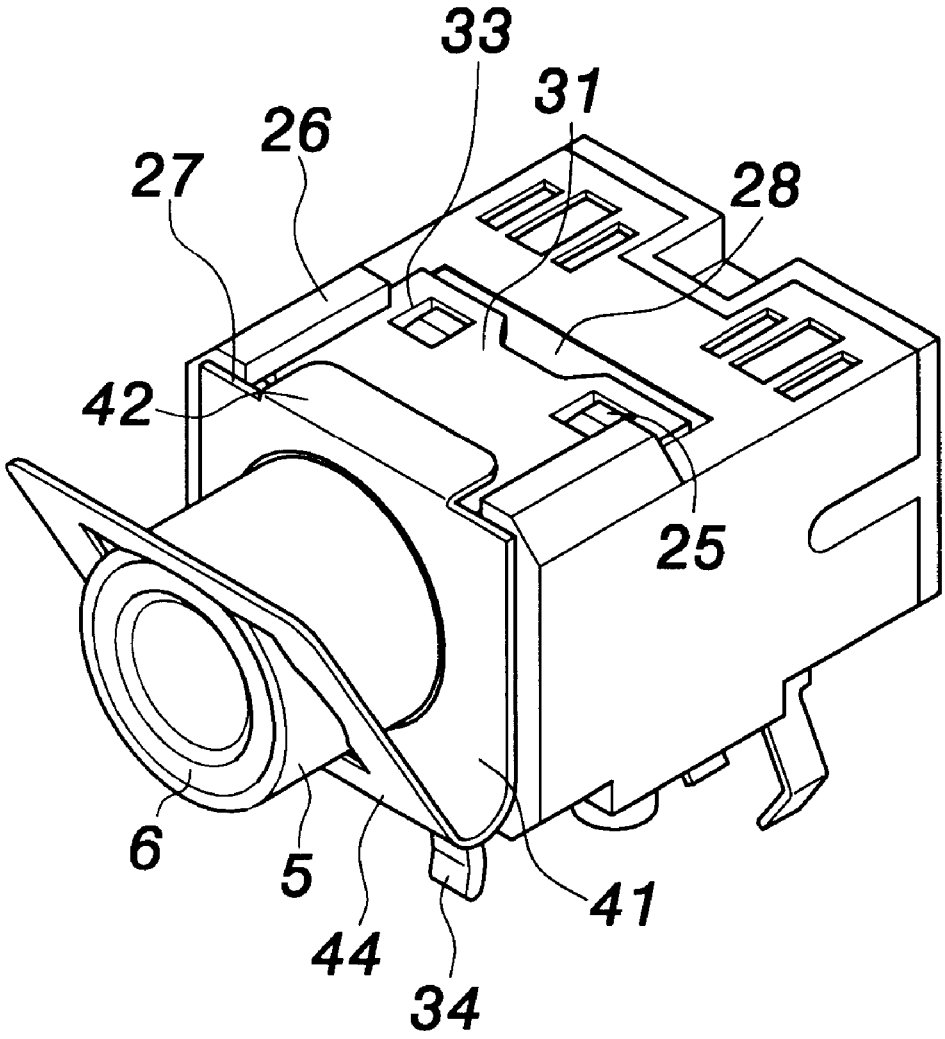
FIG. 2 is a perspective view of one embodiment of the present invention.
Figure 3:
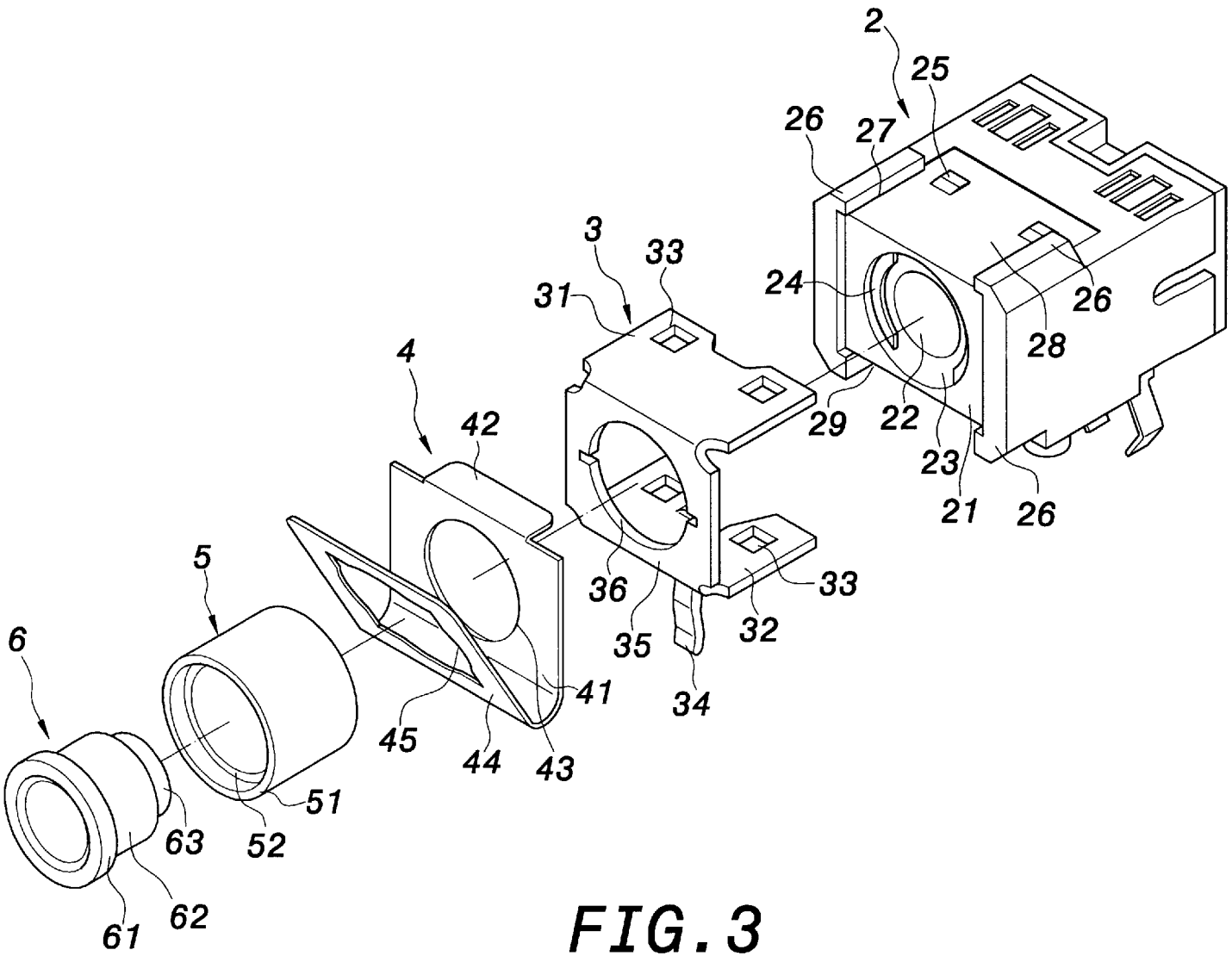
FIG. 3 is an exploded perspective view of one embodiment of the present invention.

Referring to FIGS. 2 to 5, one embodiment of the audio connector grounding piece of the present invention is illustrated. In the audio connector grounding piece, an inserting hole 22 facing outwards is installed at a front end surface of a primary seat 2. The edge of the inserting hole 22 is formed with an annular groove 23. At an inner surface of the annular groove 23 is formed a cambered strip 24. The top surface 28 and bottom surface 29 of the primary seat 2 are installed with a pair of buckles 25 and two inward folded edges 26 defining a substantial U-shape.

The top and bottom end plates 31 and 32 of a frame 3 are respectively inserted into buckling grooves 27 defined between opposing inward folded edges 26. Buckles 25 are buckled at the holes 33 formed in the two end plates 31 and 32 of the frame 3. The lower plate 32 of the frame 3 has an edge connected to a grounding pin 34. The ground pin 34 is bent. A lateral plate 35 of the frame 3 is installed with a through hole 36. Two lateral sides of the through hole 36 of the frame 3 have respectively formed therein slits 37. The lateral plate 35 of the frame 3 is received in the positioning groove 20 of the front end surface 21 of the primary seat 2 so as to be flush with two lateral edges bounding the positioning groove 20.

A ground piece 4 folded to define two halves is buckled to the inner folded edge 26 of the primary seat 2 by the outer folding 42 at a top of a longitudinal plate 41. The two halves of the ground piece 4 include a longitudinal plate 41 and a tilt plate 44 each of which has a respective hole 43 and 45.

A bushing 46 has an outer surface which has three stages that are incrementally reduced in diametric dimension towards the primary seat 2. The three stages include an outer section 61, a middle section 62, and an inner section 63.

An insulating cover 5 has an outer end 51 which has an annular trench 52 for connecting with and positioning the outer section 61 of the bushing 6. The insulating cover 5 passes through the holes 43 and 45 of the ground piece 4 and the through hole 36 of the frame 3 to be fixed to the annular groove 23 of the primary seat 2.

Figure 4:
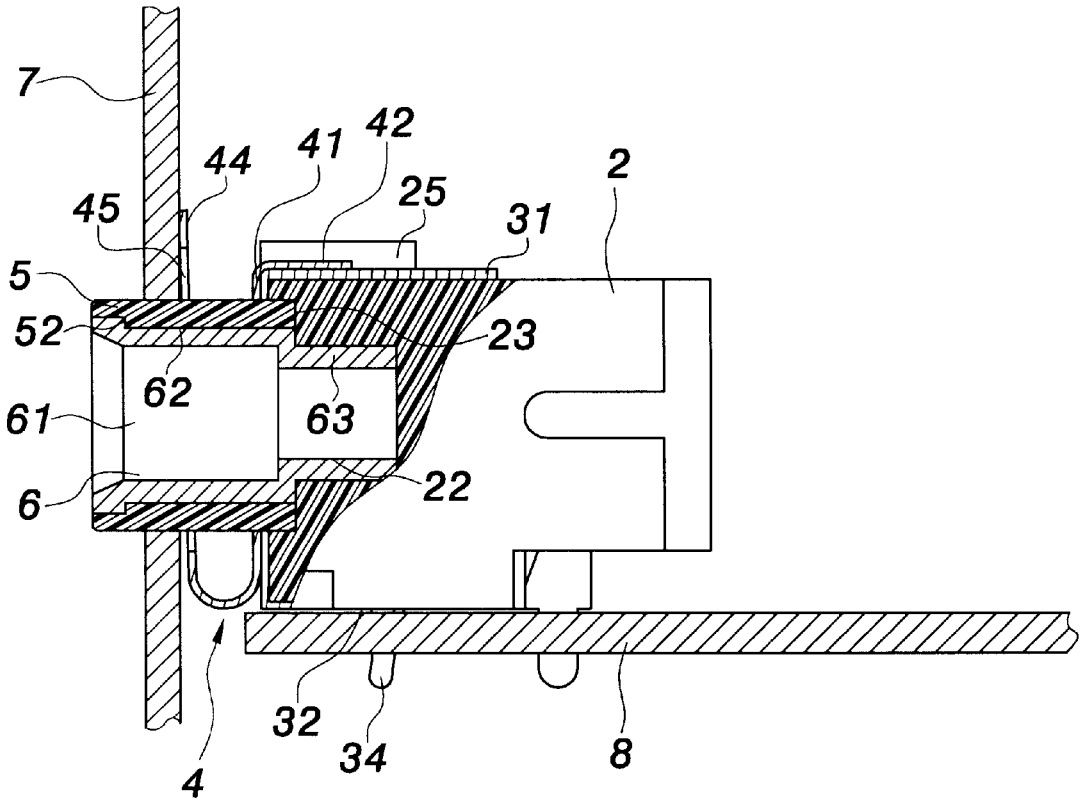
FIG. 4 is an assembled cross sectional view of one embodiment of the present invention.

In summary, in the present invention, an insulating cover is positioned in the primary seat, as shown in FIG. 4. Thus, any deficiency due to the insulating cover and the primary seat not being formed integrally is remedied. Therefore, the yield ratio is increased.

Figure 5:
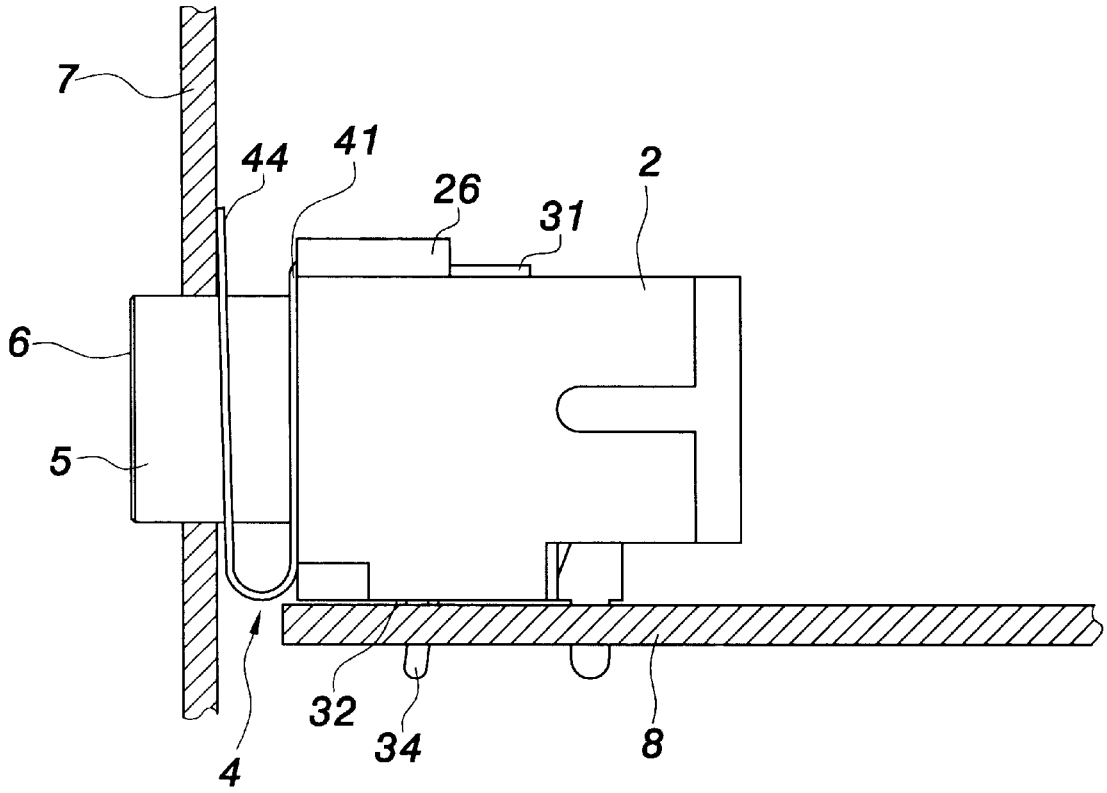
FIG. 5 is a schematic view showing an application of one embodiment of the present invention.

With reference to FIG. 5, the primary seat of the present invention is connected to a mother board 8 so that the grounding leg 34 and the terminals pass through the mother board 8 together to be positioned thereon, with the ground piece 4 bearing against the inner surface of the casing 7. As a result, the insulating cover 5 passes through the casing 7. The hollow channel of the bushing 6 provides a space for the insert of a stereo plug. Since the tilt plate 44 of the ground piece 4 bears against the inner surface of the casing 7, stable electric contact is maintained.

The longitudinal plate 41 of the ground piece 4 and the lateral plate 35 of the frame 3 are formed with a preferred surface contact. Via the frame 3, the electric waves in the casing 7 are conducted to the mother board. Conversely, the electric waves in the mother board can be conducted to the casing 7. The transmission is quick; therefore, efficient grounding is realized. Furthermore, the security of coupling of the ground piece is improved.

Although the present invention has been described with reference to the preferred embodiments, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention As defined in the appended claims.

What is claimed is:

1. An audio connector grounding piece comprising:

a primary seat having an inserting hole facing outwards and installed at a front end surface of the primary seat; an edge of the inserting hole being formed with an annular groove; a top surface and a bottom surface of the primary seat being installed with a pair of buckles and two inward folded edges, respectively; a buckling groove being formed between the inward edges and an end surface;

a frame having two end plates and a lateral plate; each end plate being inserted into the buckling groove of the primary seat, each end plate being formed with a hole, the hole being engaged with a buckle of the primary seat; a lower end plate of the frame being connected to a ground leg; and the lateral plate of the frame having a through hole;

a ground piece being formed by a longitudinal plate and a tilt plate defining two folded halves; a top of the longitudinal plate having an outward folding; the outward folding being engaged at the two inward folding edges of the top end surface of the primary seat; and a hole being formed in the tilt plate and the longitudinal plate;

a bushing having a staged outer surface facing and gradually reduced toward the primary seat; and an insulating cover having an outer end with an annular trench formed thereon, the insulating cover passing through the ground piece and the frame to be fixed to the annular groove of the primary seat.

2. The audio connector grounding piece as claimed in claim 1, wherein an inner surface of the annular groove of the primary seat has a cambered strip.

3. The audio connector grounding piece as claimed in claim 1, wherein the end and lateral plates of the frame define a substantial U-shape.

4. The audio connector grounding piece as claimed in claim 1, wherein an edge of the through hole on the lateral plate of the frame has a slit.

5. The audio connector grounding piece as claimed in claim 1, wherein the lateral plate of the frame is received in a positioning groove at the front end surface of the primary seat.

6. The audio connector grounding piece as claimed in claim 1, wherein an outer surface of the bushing has three stages.

* * * * *